United States Patent [19]

Parent

[11] 4,014,696

[45] Mar. 29, 1977

[54] MULTICOLORED XEROGRAPHIC TRANSPARENCY UTILIZING AN ALIPHATIC ESTER COATING

[75] Inventor: Richard A. Parent, Fairport, N.Y.

[73] Assignee: Xerox Corporation, Stamford, Conn.

[22] Filed: Feb. 5, 1975

[21] Appl. No.: 547,295

[52] U.S. Cl. ..... 96/1.4; 96/1.2; 427/16

[51] Int. Cl.[2] ..... G03G 13/16; G03G 13/22

[58] Field of Search ..... 96/1.4, 1.2; 427/24, 427/16, 23

[56] References Cited

UNITED STATES PATENTS

| | | | |
|---|---|---|---|
| 2,297,691 | 10/1942 | Carlson | 96/1.4 |
| 3,057,720 | 10/1962 | Hayford et al. | 96/1.2 |
| 3,535,112 | 10/1970 | Dolce et al. | 96/1.4 |
| 3,539,341 | 11/1970 | Dolce et al. | 96/1.4 |
| 3,549,360 | 12/1970 | O'Neill et al. | 96/1.4 |
| 3,949,148 | 4/1976 | Akman | 96/1.2 X |

*Primary Examiner*—Thomas J. Herbert, Jr.

[57] ABSTRACT

A transparency is disclosed, which is suitable for use in a multicolored xerographic reproduction process comprising a transparent, thermoplastic film sheet having at least one surface coated with a long chain aliphatic ester. The ester coated transparency, when used in a multicolored electrostatic copying process improves adhesion of the multicolored image thereon and permits reproduction of colors and color densities in said image which correspond to the multicolored original.

8 Claims, No Drawings

MULTICOLORED XEROGRAPHIC TRANSPARENCY UTILIZING AN ALIPHATIC ESTER COATING

BACKGROUND OF THE INVENTION

This invention relates to xerographic reproduction and specifically to transparencies which are suitable for use in a xerographic reproduction process.

Transparencies are a highly useful product in visual education since an image on a transparency may be projected with the necessary degree of magnification onto a screen where it may be viewed by a large number of persons. Transparencies have heretofore been made by photographic reproduction of the desired image and accordingly have required the skill of an individual who is familiar with complex photographic reproduction processes. Photographic reproduction of transparencies also requires the expenditure of a large amount of time and money and is thus undesirable for this reason. Therefore, an easy and inexpensive means for the production of transparencies has been sought whereby transparencies could be conveniently and economically imaged and then used an unlimited number of times in visual education programs.

The advent of xerography and electrostatic copying as generally disclosed by Carlson in U.S. Pat. No. 2,297,691 has proven to be a highly successful process for reproduction with the inherent advantages of speed and reliability. In a usual xerographic process, an electrostatic image of an object is formed on a recording member such as xerographic plate or drum. The xerographic plate may comprise a layer of photoconductive material, such as selenium on a conductive metal backing. The latent electrostatic image which is formed on the photoconductive material is developed into a powder image which is then subsequently transferred to a sheet of paper and affixed thereon to form a permanent print.

The xerographic process has therefore proven to be an easy and reliable means for the production of transparencies. Transparencies made by a xerographic process are produced by forming an electrostatic image of the desired object, developing it, and then transferring it to a transparent sheet material with the image being permanently affixed or fused thereto by either the application of heat or by the action of a solvent vapor. In either case the toner which is used to develop the powdered image is coalesced on the sheet material by the fusing technique to form a permanent image thereon. Solvent fusion techniques, for transparent materials made by a xerographic process, for example, are illustrated in U.S. Pat. Nos. 3,049,810 and 3,148,078.

While the xerographic reproduction process is an apparent solution to the problem of economical and efficient production of transparencies, other problems have also been encountered with its use in the production of transparencies. One of the most pronounced problems with producing transparencies by an electrostatic copying process is to get the powdered or developed image to adhere well to a transparent film material before the image is permanently affixed thereto by fusing. Failure to achieve this results in partial or "cracked" images. A further problem encountered is obtaining proper and uniform density of the image after fixing or fusion and without resultant damage to the transparent film material either in the fusion process or in the transfer system employed within the machine. For this reason, various coating and combinations thereof with various types of transparent sheet materials have been previously proposed to obviate some of these difficulties. Included are various single component polymeric coatings such as are exemplified in U.S. Pat. Nos. 3,539,341 and 3,535,112. Additionally, U.S. pat. No. 3,549,360 discloses a transparency coated with inorganic salts of fatty acids. The coated transparency is utilized in electrostatic copying.

The above coatings, while of some assistance in improving adhesion of the developed electrostatic image to a transparent film material, nevertheless, are not entirely suitable when transparencies are produced by a multicolored xerographic imaging process. The difficulties encountered with a multicolored imaging process and transparencies produced thereby are due in part to the multicomponent pigment developers required in the multicolored imaging process and their varying degree of attraction for the transparent sheet material. Furthermore, the problem of getting the correct degree of coalescence of the toner particles in the permanent image is an even more critical matter with multicolored imaging than with single color image development. This increased criticality is due to the fact that single color transparent images only require complete opaqueness or nonopaqueness of varying degrees to produce a transparency which has images suitable for projection.

Multicolored transparency images, on the other hand, must allow for a certain degree of color density for each color or color combination in the image which is sufficient and uniform enough to allow projection of a uniform and true color. This, therefore, requires a different and unique combination of materials being employed and more critical controls being imposed upon the transparent materials which are used in a multicolor xerographic imaging process to obtain the correct degree of attraction of toner to the transparent sheet as well as proper coalescence of toner particles for good color density.

The instant invention relates to a transparency wich fulfills all the requirements for use in the production of multicolored electrophotographic images. The subject invention is particularly suited to overcome difficulties associated with the projection of color xerographic images which are formed on transparencies. In addition, the instant invention utilizes materials which are readily available and are relatively simple to work with. By means of the subject invention effective transparencies for use in a xerographic color process are easily prepared.

It is an object of the present invention to provide a transparency which is permanent in nature and having the sheet strength necessary to allow repeated use thereof for visual education purposes.

It is also an object of the present invention to provide for production of a color transparency by a xerographic multicolor imaging process wich in turn eliminates the skill of a technician who is trained in reproduction photographic processing.

These and other objects, as well as the scope, nature and utilization of this invention will be apparent by the following detailed description and appended claims.

SUMMARY OF THE INVENTION

It has now been determined that the general objective of producing a transparency which will permanently hold a true and consistent multicolor xerographic image may be best achieved by utilizing a transparent, thermoplastic, film sheet such as a polysulfone, polycarbonate, or polyester sheet material, which has been coated prior to xerographic imaging with a long chain aliphatic ester. Preferred aliphatic esters include glycerol monostearate, sorbitan tristearate, sorbitan monopalmitate, sorbitan monostearate, and ethylene glycol monostearate. It is the aliphatic ester coatings which has been found to insure that all colored pigments required in the multicolored reproduction process are properly attracted to and held by the transparent sheets during imaging and sheet so that a permanent image having a uniform and accurate color densities may be then fused on the transparent sheet. This treatment overcomes the previously noted difficulties with producing a transparency by a multicolored electrostatic copying process, among which are poor adherence of the developed xerographic image on the transparent film, as well as difficulty in insuring that a consistent and true color density is developed from the colored original which will also be suitable for projection or magnification on a screen. The present transparency coating materials minimize light scattering from the toner substrate interface thereby resulting in projectable transparency images. As indicated, these problems while existing with single color xerographic imaging, are even more pronounced when a multicolored xerographic process is employed.

The instant method of xerographically preparing a color transparency copy includes: (a) forming a single color powder image of a multicolored original to be reproduced; (b) transferring the powder image to a transparency comprising a thermoplastic film sheet, said sheet having at least one surface coated with a long chain aliphatic ester; and (c) fixing the powder image on the coated transparency. For multicolored reproduction, the steps of powder image formation and transfer are repeated before the fixing step, each sequence corresponding to the formation of a different color to effect multicolor reproduction, said transfer of each developed electrostatic image taking place in registration on the transparency.

DESCRIPTION OF THE PREFERRED EMBODIMENT

In the process of multicolored xerographic reproduction, a substractive color to color reproduction technique is used to develop images formed on the photoconductive layer. Furthermore, a multicolor xerographic imaging process may also employ multiple scanning of the colored original at different wavelengths of light to produce multiple images corresponding to each primary color involved in the original. These primary color images may be then recombined to form a single multicolored image corresponding to the original by using a multicomponent or multicolored toner in a subtractive color to color reproduction process. A subtractive color to color reproduction process is illustrated in U.S. Pat. No. 3,057,720.

Toners which are employed in multicolor xerography use subtractive primary colors, yellow, cyan (blue green) and magenta. These in turn are used to reproduce a wide gamut of colors normally found in the colored original. For the purposes of illustration, when subtractive mixing of the yellow and cyan colorants take place, greens are obtained. Likewise, the mixing of magenta and yellow colorant in varying amounts reproduce reds, while combining the cyan with magenta results in the reproduction of blues. Mixtures of appropriate amounts of each toner, of course, will produce a black image.

Production of the multicolored copy from the colored original may be appropriately achieved by any multicolored xerographic imaging process. It is not intended that this invention be limited by particular variations in the multicolored xerographic imaging processes that might be employed or with the equipment used in said process. Nevertheless, for the purposes of illustration, a suitable process for color imaging begins with proper discernment of the color composition of the original subject matter and recording thereof. This may be conveniently accomplished by sequential optical scanning of the color original a number of times to formulate a sequence of the latent electrostatic images which correspond to the primary colors in the original. This is accomplished by the light image passing through an appropriate color filter so that the latent image is then in effect, color separated according to the various primary colors. Theoretically, the latent image which is formed by passing the light image through a green filter should require the magentas (the complementary color) as areas of relatively high charge density on the drum surface, while the green (the separated color) should cause a low-charged density level. The magentas are then made visible by applying a green absorbing magenta toner to the image bearing member. In the same manner, a blue separation is developed with a cyan toner. The three developed color separations are then brought together in registration upon the final sheet of support material to produce a multicolored facsimile of the original colored document copy.

It is this multicomponent developer system used in a subtractive color to color reproduction process which presents numerous problems, when, for example, a color transparency is produced thereby which will reproduce, with uniform and accurate consistency the color densities which correspond to the colored original.

In the production of transparencies by a multicolored xerographic imaging process according to the present invention, a transparent, thermoplastic film sheet is selected as the support material upon which the multicolored xerographic image is to be developed. Although the sheet material may be any suitable thermoplastic film material which has the clarity strength, and heat resistance to allow repeated projection thereof, materials which are particularly prepared for the present invention include thermoplastic resins such as polysulfones, polycarbonates, or polyesters.

Thermoplastic sheet material which may be conveniently utilized in the present invention includes polysulfone sheet material which are commercially available from Rowland Products Inc., Kensington, Connecticut and Instar Supply Co., Inc., New York, New York under the name Folacron PSN, as well as polycarbonate sheet materials commercially available from General Electric Corp., Waterford, New York under the names LEXAN SI1007 (a tetrachloro-polycarbonate) and LEXAN DL616 (a tetrabromo polycarbonate). These materials may be selected from any thickness range desired, although in selecting film thickness, the films should be thick enough to have the necessary strength but still be thin enough to remain flexible and transparent throughout continuous use thereof. A suitable thickness of the film suitable for use in xerographic imaging, will generally be 3 to 8 mils.

Within the purview of the present invention, the thermoplastic film material is coated with a long chain aliphatic ester compound by applying said amide as a coating solution to the surface of the film and thereafter allow the coating to dry. The coating can be carried out by immersing the films in the respective solution of solvent and the organic ester or blade (or spray) coating one surface of the film. The aliphatic ester coating has been found to increase the compatibility between the toner and transparency surface thereby resulting in a smoother interface and a more transparent (projectable) image.

The aliphatic ester compounds within the purview of the instant invention should be nonvolatile and have a melting point above 40° C. While any and all aliphatic, alicyclic, or branched aliphatic esters having these characteristics fall within the purview of the present invention, preferred compounds include glycerol monostearate, sorbitan tristearate, sorbitan monopalmitate, sorbitan monostearate, ethylene glycol monostearate, and mixtures thereof. Films coated with these particular compounds have been found to give optimum results.

An applied mixture will be generally coated on the transparent film material in the form of a solution and because of this, the choice of solvents to provide the solution is important, relative to the coating composition, since it must not cloud or change the film material. It must at the same time, provide enough solubility for the aliphatic ester compound to provide a clear uniform coating on the transparency with no evidence of component insolubility.

Suitable solvents for the organic esters of the present invention are those organic liquids which will dissolve the compounds but which are nonsolvents for the substrate material. The solvent composition found to be suitable for use with the present compounds and for their application to transparencies produced therewith are hydrocarbon solvents such as hexane. Additionally, alcohols such as ethanol and isopropanol can be used. And further, mixtures of conventional aliphatic ester solvents may be employed to attain the requisite coating on the transparency. Aside from the selection features mentioned above, the particular solvent utilized is not considered critical to the ultimate transparencies formed within the purview of the present invention.

The organic aliphatic ester materials which may be used in the coating of the present invention may be any commercially available form of these materials. Exemplary of commercial products include Starfol Ester (glycerol monostearate) supplied by the Ashland Oil Company of Columbus, Ohio; Emsorb 2507 (sorbitan tristearate), Emsorb 2510 (sorbitan monopalmitate), and Emsorb 2505 (sorbitan monostearate) all supplied by Emery Industries of New York; and Grocor 5220 (ethylene glycol monostearate) supplied by the A. Gross Co. of New York.

The coating compound after dissolution in the appropriate solvent mixture is applied to the transparent thermoplastic film by techniques which are well known to those skilled in the art of coating. Various techniques which are suitable for coating could be by roll, air knife, or any other uniform application means used in paper coating. For instance, the film may be simply passed (or dipped) through a hopper containing the coating composition in liquid form, which is provided by a doctor blade or the coating may be applied by use of a more precise coating apparatus such as a gravure press. After coating the film with aliphatic ester compound, the film is allowed to dry.

As a general procedure, after the ester coated transparency is prepared, copies mare made in a Xerox Model D processor (flat plate) using a premixed developer containing 10g of Xerox Cyan Toner, internally designated at XT 1318C-13, and 500g of carrier material, internally designated as XC 910-20. Print fixing is accomplished in a Xerox Model D fuser which had temperatures ranging between 150°–170° C. Alternatively heated roll or vapor fusing may be used. The resulting transparencies are judged by projection using a "Telegraph-Resolute" mode 21105 overhead projector and rating on a transparency scale of from 1 to 10. Therefore, a rating of 1 indicates that no color whatsoever was visible on the projection screen while a rating of 10 indicates complete transparency. Ratings above 5 can be expected utilizing the long chain aliphatic ester coatings of the present invention.

When the aliphatic ester coated transparent sheet material was subjected to a colored xerographic imaging process, as outlined above, with heat fixing of the adherent image, it is observed that superior image adhesion occurred both before and after the fixing step. In addition, the color reproduced were uniform, with consistent color density and with no evidence of toner "spotting".

While the foregoing description represents the preferred embodiments of the present invention, it will be obvious to those skilled in the art that various changes and modifications may be made therein without departing from the true spirit and scope of the present invention.

What is claimed is:

1. A method of xerographically preparing a color transparency copy comprising the sequence of:

a. forming a single color xerographic powder image of a multicolored original to be reproduced;

b. transferring the powder image to a transparency comprising a thermoplastic film sheet, said sheet having at least one surface having been coated with a nonvolatile long chain aliphatic ester having a melting point above 40° C wherein said long chain aliphatic ester is selected from the group consisting of glycol monostearate sorbitan tristearate, sorbitan monopalmitate, sorbitan monostearate, ethylene glycol monostearate and mixtures thereof; and c. then, repeating said sequence in steps (a) and (b), where each sequence corresponds with the formation of a different color to effect multicolor reproduction, said transfer of each developed electrostatic image taking place in registration on the transparency;

d. fixing the powder image on the transparency.

2. The method of claim 1 wherein the steps of powder image formation and transfer are repeated before the fixing step, each sequence corresponding to the formation of a different color to effect multicolor reproduction, said transfer of each developed electrostatic image taking place in registration on the transparency.

3. The method of claim 1 wherein the fixing is carried out by vapor fusion.

4. The method of claim 1 wherein the fixing is carried out by heating.

5. The method of claim 4 wherein the heat fixing is carried out by roll fusing.

6. The method of claim 4 wherein the heat fixing is carried out by radiant fusing.

7. The method of claim 1 wherein the transparency used in the transfer step is a thermoplastic film sheet of polysulfone, polycarbonate, or polyester material.

8. The method of claim 7 wherein the transparency is a polyester film sheet.

* * * * *